US010779697B2

(12) United States Patent
Walz et al.

(10) Patent No.: US 10,779,697 B2
(45) Date of Patent: Sep. 22, 2020

(54) METHOD FOR ADJUSTING A POSITION OF SUCTION LIPS OF A FLOOR CLEANING MACHINE AND FLOOR CLEANING MACHINE

(71) Applicant: Alfred Kärcher GmbH & Co. KG, Winnenden (DE)

(72) Inventors: Juergen Walz, Moeckmuehl (DE); Melanie Ritscher, Oberndorf (DE); Wilhelm Eisenmann, Althuette (DE)

(73) Assignee: Alfred Kärcher SE & Co. KG, Winnenden (DE)

( * ) Notice: Subject to any disclaimer, the term of this patent is extended or adjusted under 35 U.S.C. 154(b) by 244 days.

(21) Appl. No.: 14/947,504

(22) Filed: Nov. 20, 2015

(65) Prior Publication Data

US 2016/0073845 A1 Mar. 17, 2016

Related U.S. Application Data

(63) Continuation of application No. PCT/EP2013/060962, filed on May 28, 2013.

(51) Int. Cl.
*A47L 11/30* (2006.01)
*A47L 11/40* (2006.01)

(52) U.S. Cl.
CPC ..... *A47L 11/4058* (2013.01); *A47L 11/305* (2013.01); *A47L 11/4011* (2013.01); *A47L 11/4044* (2013.01)

(58) Field of Classification Search
None
See application file for complete search history.

(56) References Cited

U.S. PATENT DOCUMENTS

| | | | | |
|---|---|---|---|---|
| 3,649,995 | A * | 3/1972 | Ison | A47L 11/30 15/320 |
| 4,483,041 | A | 11/1984 | Waldhauser et al. | |
| 4,667,364 | A | 5/1987 | Meili | |
| 5,212,848 | A | 5/1993 | Geyer | |
| 5,319,828 | A | 6/1994 | Waldhauser et al. | |
| 5,987,696 | A | 11/1999 | Wang | |
| 6,073,304 | A * | 6/2000 | Knowlton | A47L 11/30 15/320 |
| 6,176,940 | B1 | 1/2001 | Wang | |

FOREIGN PATENT DOCUMENTS

| | | |
|---|---|---|
| DE | 41 37 886 | 5/1993 |
| DE | 694 09 462 | 9/1998 |
| DE | 10 2008 010 068 | 8/2009 |
| EP | 1 997 417 | 12/2008 |
| WO | WO 93/10702 | 6/1993 |

* cited by examiner

*Primary Examiner* — Katelyn B Whatley
(74) *Attorney, Agent, or Firm* — Womble Bond Dickinson (US) LLP

(57) ABSTRACT

A method for adjusting a position of suction lips of a floor cleaning machine relative to a floor to be cleaned is proposed, wherein a first suction lip and at least one second suction lip located at a distance therefrom, which are arranged on a suction beam, contact the floor, a fan device generates a suction flow which subjects a space between the first suction lip and the second suction lip to a negative pressure, a negative pressure is detected, and the suction flow is adjusted such that the negative pressure lies at a set value or in a set value range, so that an angle of incidence of the first suction lip and the second suction lip on the floor lies at a set value or in a set value range.

10 Claims, 5 Drawing Sheets

METHOD FOR ADJUSTING A POSITION OF SUCTION LIPS OF A FLOOR CLEANING MACHINE AND FLOOR CLEANING MACHINE

CROSS-REFERENCE TO RELATED APPLICATIONS

This application is a continuation of international application number PCT/EP2013/060962 filed on May 28, 2013, which is incorporated herein by reference in its entirety and for all purposes.

BACKGROUND OF THE INVENTION

The invention relates to a method for adjusting a position of suction lips of a floor cleaning machine relative to a floor to be cleaned, wherein a first suction lip and at least one second suction lip located at a distance therefrom, which are arranged on a suction beam, contact the floor, and a fan device generates a suction flow which subjects a space between the first suction lip and the second suction lip to a negative pressure.

The invention also relates to a floor cleaning machine, comprising a suction beam on which a first suction lip and at least one second suction lip are arranged, and a fan device for generating a suction flow which subjects a space between the first suction lip and the second suction lip to a negative pressure.

A method for brush roller control of a vacuum cleaner floor nozzle is known from DE 41 37 886 A1.

A vacuum cleaner with an electric motor controlling a fan for generating an internal negative pressure and a flow of suction air is known from DE 694 09 462 T2. Means for controlling the speed of the electric motor are provided, which are designed for continuously controlling the speed of the electric motor as a function of the result of the measurement of a negative pressure and a differential pressure.

A device for automatic suction power control of a vacuum cleaner is known from DE 10 2008 010 068 A1.

A method for operating a vacuum cleaner with a suction fan driven by a fan motor and with a control device acting on the fan motor, the control device specifying as control variable the motor power or a parameter influencing the motor power, and in doing so taking into account the negative pressure generated by the suction fan, is known from EP 1 997 417 A2. The control device detects the negative pressure from the motor speed and a characteristic value correlating with the power of the fan motor.

A method of adjusting a vacuum level in a carpet cleaning machine is known from U.S. Pat. No. 6,176,940 B1.

SUMMARY OF THE INVENTION

In accordance with the present invention, a method is provided, with which an optimized vacuuming result is obtained.

In accordance with an embodiment of the invention, a negative pressure is detected, and the suction flow is adjusted such that the negative pressure lies at a set value or in a set value range, so that an angle of incidence of the first suction lip and the second suction lip on the floor lies at a set value or in a set value range.

The relative positioning of the suction lips in relation to the floor to be cleaned and, therefore, their angle of incidence depends upon the prevailing negative pressure. The negative pressure is determined, on the one hand, by the power of the fan device and, on the other hand, by the flow of ambient air into the space between the suction lips. The prevailing negative pressure is, in turn, dependent upon the floor structure conditions. For example, with the same power of the fan device, a higher negative pressure prevails with a smooth floor than with a rougher floor. The prevailing negative pressure may also depend upon the type of cleaning such as wet cleaning or dry vacuuming.

An optimized vacuuming result is obtained when the angle of incidence is not too steep and not too flat. For example, a set value for an angle of incidence is typically approximately 60°. It may, however, differ in accordance with the distance from the floor.

In the solution in accordance with the invention, the angle of incidence is adjusted to the set value or to the set value range by adjusting the negative pressure. This negative pressure is, in turn, adjusted by way of the fan device and, in particular, regulated so that the optimized vacuuming result is also obtained with varying floor structure conditions.

The method in accordance with the invention can be carried out, in particular, automatically. If, for example, during driving operation of the floor cleaning machine, the floor structure conditions change, an adjustment can then automatically take place in order to obtain an optimized vacuuming result.

It is, in particular, thereby achievable that the angle of incidence of the suction lips is at least almost constant also when the floor structure conditions change during driving operation. In one embodiment, the negative pressure is measured by one or more pressure sensors.

The negative pressure can thereby be directly detected, and, in particular, a set value control (regulation) carried out.

It is expedient for the negative pressure to be detected at the suction beam. It can thereby be measured in simple way.

It is quite particularly advantageous for the suction flow to be adjusted by adjusting the power of the fan device. The negative pressure can be adjusted to a set value or a set value range by corresponding activation of a motor of the fan device. (In principle, it is also possible to adjust the suction flow using corresponding flow elements such as flaps, etc.; simple adjustability is achieved by adjusting the power of the fan device.)

In particular, the suction flow is adjusted automatically, i. e., without user intervention. With optimized manageability of the floor cleaning machine, an optimized cleaning result is thereby obtained.

It is, in particular, advantageous for the negative pressure adjustment to be regulated with the regulation aim that the negative pressure detected lies at a set value or in a set value range. In particular, simple automatic adjustment is thereby achieved.

The regulation aim is (indirectly) a certain relative position of the suction lip in relation to the floor, i. e., a certain angle of incidence or a certain angle of incidence range, in order to obtain an optimized vacuuming result.

In particular, the set value or set value range for the angle of incidence of the first suction lip and the second suction lip on the floor lies in the range between 35° and 70° and, for example, at approximately 45° or approximately 60°. An optimized vacuuming result is then achieved.

It is expedient for the suction beam to be floatingly mounted on a chassis of the floor cleaning machine and, in particular, to be pressed against the floor. There is then no need to provide additional support by means of one or more wheels for the suction beam. A corresponding wheel can leave a streak on the floor to be cleaned.

It is expedient for the first suction lip and/or the second suction lip to comprise one or more cut-outs through which it is possible for ambient air to flow into the space between the first suction lip and the second suction lip. Optimized vacuuming is thereby achieved.

For example, the set value or set value range for the negative pressure and/or the angle of incidence is stored in a table or as function. In principle, the set value or set value range depends on the construction of the suction beam and also on the construction of a spring device by means of which the suction beam is floatingly mounted.

In accordance with the invention, a floor cleaning machine is provided, which can be operated with an optimized vacuuming result.

In accordance with an embodiment of the invention, a negative pressure detection device is provided, and a control device is provided, to which the negative pressure detection device is coupled with signaling effect, the control device controlling the subjection to negative pressure in dependence upon signals of the negative pressure detection device in such a way that a negative pressure lies at a set value or in a set value range, so that an angle of incidence of the first suction lip and the second suction lip on a floor to be cleaned lies at a set value or in a set value range.

The floor cleaning machine in accordance with the invention has the advantages explained hereinabove in conjunction with the method in accordance with the invention.

Advantageous configurations of the floor cleaning machine in accordance with the invention have been explained hereinabove in conjunction with the method in accordance with the invention.

In particular, the method in accordance with the invention can be carried out on the floor cleaning machine in accordance with the invention.

The control device is expediently coupled with signaling effect to the fan device and controls its power. A set value for the negative pressure, which is relevant for the angle of incidence of the suction lips, can thereby be adjusted in a simple way.

In particular, the negative pressure detection device comprises one or more pressure sensors. The corresponding negative pressure can thereby be directly detected.

It is then expedient for the pressure sensor or pressure sensors to be arranged on the suction beam. The corresponding negative pressure can thereby be detected in a simple way.

It is expedient for the suction beam to be floatingly mounted on a chassis of the floor cleaning machine. There is then no necessity for additional support by wheels. The suction beam can be pressed against the floor to be cleaned, so that the suction lips contact it.

In particular, a spring device is provided, which presses the suction beam against the floor to be cleaned. An optimized vacuuming result is thereby achievable. In an alternative embodiment, a spring device is provided, which provides a restoring force (away from the floor), with the suction beam being pressed by its own weight against the floor. Such a spring device provides stabilization, for example, when cornering.

In one embodiment, the first suction lip and/or the second suction lip comprises or comprise one or more cut-outs through which it is possible for ambient air to flow into the space between the first suction lip and the second suction lip. An effective vacuuming from the space between the first suction lip and the second suction lip is thereby achievable. The cut-outs may, for example, be configured as continuous openings on the first suction lip and/or the second suction lip. It is, for example, also possible for channels to be formed on the first suction lip and/or the second suction lip, which, when the corresponding suction lip is pressed with sufficient strength onto the floor to be cleaned, open a larger cross-sectional area in comparison with the case where the corresponding suction lip is not pressed onto the floor.

It is expedient for the floor cleaning machine to be self-propelled. This results in effective cleaning of large surfaces. By virtue of the solution in accordance with the invention, an optimized vacuuming result is also achieved with varying floor structure conditions. The floor cleaning machine may, for example, be designed as a ride-on machine or as a floor cleaning machine which is a "walk-behind" floor cleaning machine, which is guided by an operator. The floor cleaning machine may, for example, also be designed as a robot vacuum cleaner. It may, for example, also be designed as an apparatus without any prescribed direction of movement such as a hand-held apparatus.

The following description of preferred embodiments serves in conjunction with the drawings to explain the invention in greater detail.

BRIEF DESCRIPTION OF THE DRAWINGS

FIG. 3(*b*) shows a second example of an angle of incidence;

FIG. 3(*c*) shows a third example of an angle of incidence;

DETAILED DESCRIPTION OF THE INVENTION

Figure 1:
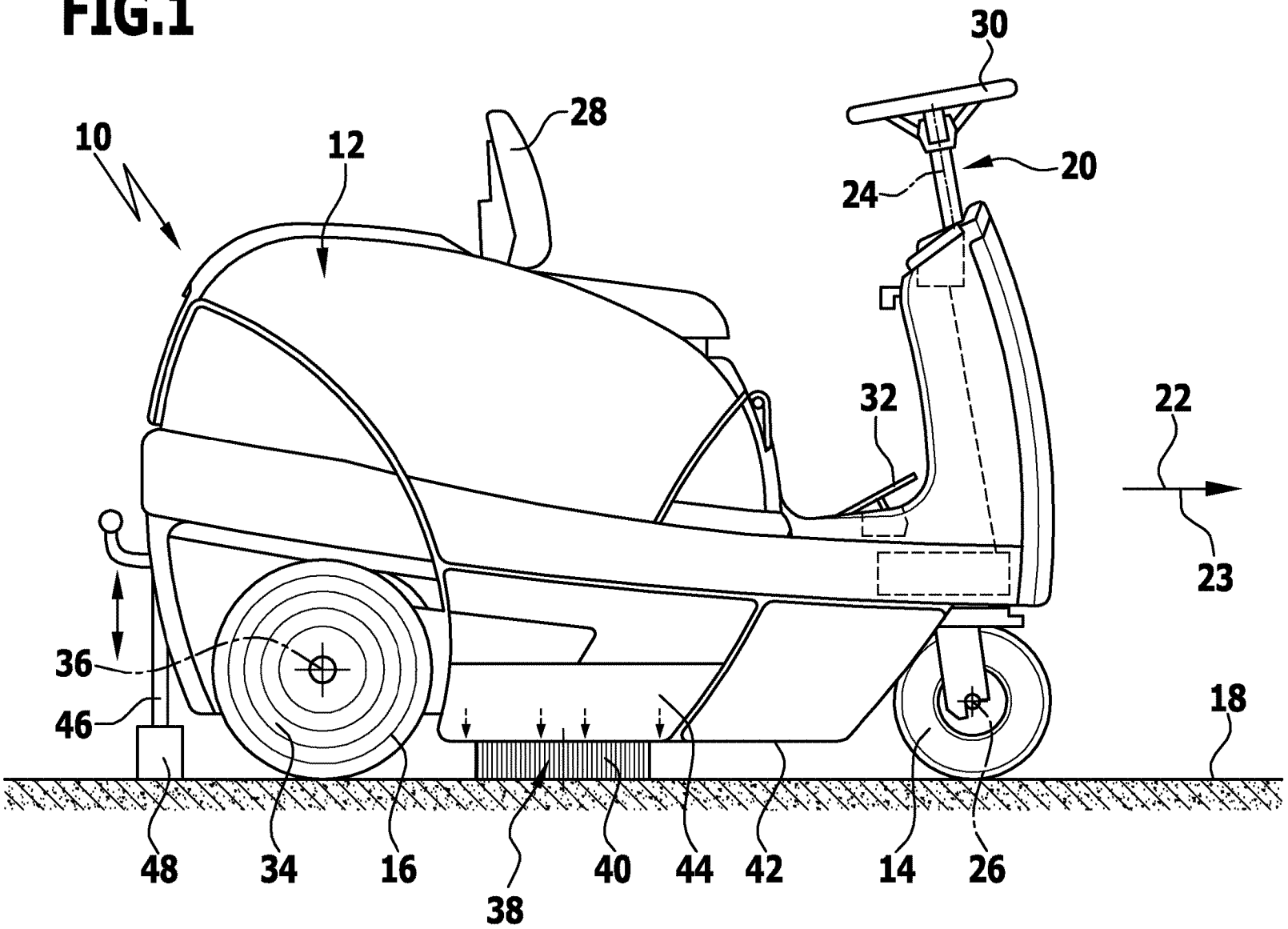
FIG. 1 shows a schematic side view of an embodiment of a floor cleaning machine.

An embodiment of a floor cleaning machine is a self-propelled floor cleaning machine which is shown schematically in FIG. 1 and designated therein by 10. The floor cleaning machine 10 comprises a chassis 12. A front wheel 14 and a rear wheel assembly 16 are mounted on the chassis 12. The floor cleaning machine can travel on a floor 18 to be cleaned by means of the front wheel 14 and the rear wheel assembly 16.

In one embodiment, the front wheel 14 is connected to a steering device designated in its entirety by 20. An angular position of the front wheel 14 in relation to a center plane of the floor cleaning machine 10 can be set by the steering device 20. During straight-ahead travel (indicated by reference numeral 22 in FIG. 1) the front wheel 14 is aligned parallel to this center plane and a corresponding steering angle is a zero angle.

Straight-ahead travel 22 includes forward travel 23 (cf. also FIG. 3) and reverse travel.

The steering device 20 defines a steering axis 24. The steering axis 24 preferably lies in the center plane. The steering axis 24 is oriented transversely and, for example, perpendicularly to a wheel axis 26 of the front wheel 14. The front wheel 14 is rotatable about the wheel axis 26. The wheel axis 26 extends transversely to the center plane. During straight-ahead travel 22 in the straight-ahead direction, the wheel axis 26 is oriented perpendicularly to the center plane.

Arranged on the chassis 12 is a seat 28 for a driver. A driver seated on the seat 28 can operate a steering wheel 30 of the steering device 20.

In one embodiment, the floor cleaning machine 10 comprises an accelerator pedal 32 and a brake pedal as actuating elements. By actuation (in particular, actuation by foot) of this accelerator pedal 32, an operator specifies the speed of the floor cleaning machine 10. A drive for the front wheel 14 and/or the rear wheel assembly 16 is provided for this.

The rear wheel assembly 16 comprises (at least) one left rear wheel and (at least) one right rear wheel. Here the designation "left" and "right" relates to the direction of forward travel in straight-ahead travel 22.

The left rear wheel and the right rear wheel 34 are rotatable about a common wheel axis 36. The wheel axis 36 is fixed in relation to the center plane and perpendicular thereto; in particular, the rear wheel assembly 16 is unsteered.

In the embodiment shown, the floor cleaning machine 10 is three-wheeled.

The floor cleaning machine 10 is constructed as a scrubber-suction machine. It comprises a floor cleaning appliance 38 which, in the embodiment shown, is a scrubber floor cleaning appliance. The scrubber floor cleaning appliance has scrubbing elements 40 arranged on an underside 42 of the chassis 12. A scrubbing element 40 is arranged between the rear wheel assembly 16 and the front wheel 14, for example, rotatably so as to face the floor 18 on which the floor cleaning machine 10 stands.

The floor cleaning appliance 38 further comprises an application device 44 for cleaning liquid, with which cleaning liquid can be applied to an application area on the floor 18 to be cleaned. The cleaning liquid is, for example, a mixture of water and a chemical cleaning additive. The application device 44 comprises a plurality of nozzles through which the cleaning liquid can be applied to the application area. The nozzles may be arranged in one or more rows.

The nozzles are so arranged and constructed that the scrubbing element or scrubbing elements 40, which are cleaning tools, are directly sprayed or cleaning liquid gets from there onto the floor 18 and/or that the floor 18 is sprayed.

The application area for cleaning liquid lies between the front wheel 14 and the rear wheel assembly 16.

A tank for cleaning liquid is arranged on the chassis 12. The tank may include an area for, for example, water and an area for chemical additives. The nozzles are supplied with cleaning liquid by way of the tank or by way of a mixing area.

The floor cleaning machine 10 comprises a suction device 46 by means of which liquid can be sucked up from the floor 18. The suction device 46 comprises a suction beam 48 on which (at least) a first suction lip 50 and a second suction lip 52 (FIGS. 2, 3(*a*), 3(*b*), 3(*c*), 4) are arranged.

Figure 2:
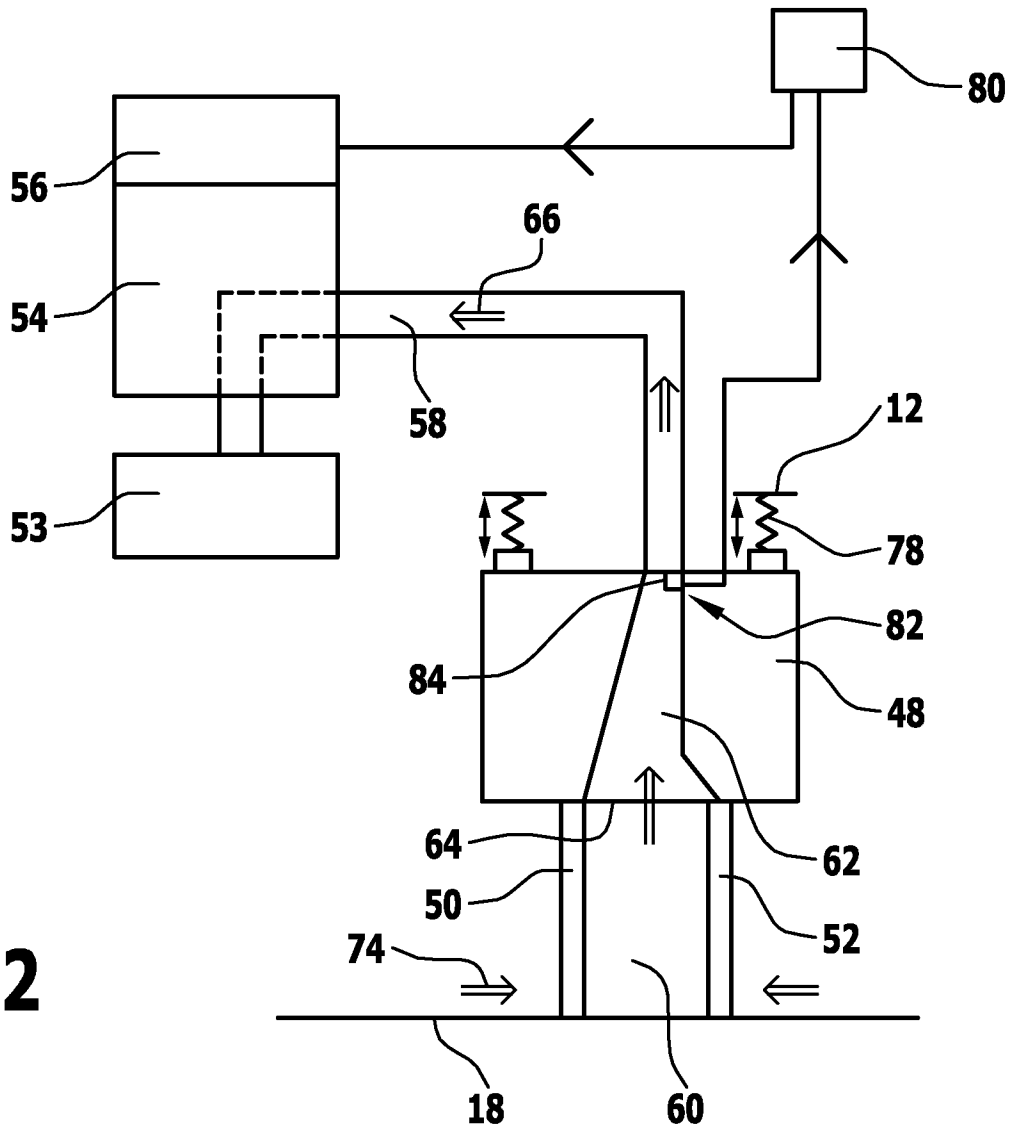
FIG. 2 shows a schematic representation of a suction beam with suction lips and coupling to a fan device.

In the embodiment shown, the suction beam 48 is arranged, in relation to a forward direction of travel, behind the rear wheel assembly 16. The second suction lip 52 lies closer to the rear wheel assembly 16 than the first suction lip 50. Liquid is sucked in by way of the suction beam 48 and collected in a dirty water tank 53 (FIG. 2).

In an alternative embodiment, a suction beam corresponding to the suction beam 48 is arranged in front of the rear wheel assembly 16. The suction beam may also be arranged directly on the floor cleaning appliance 38. The suction beam may also be directly integrated in the floor cleaning appliance.

It is, for example, also possible for a suction beam to be arranged in front of the floor cleaning appliance 38 (between the floor cleaning appliance 38 and the front wheel 14) or behind the floor cleaning appliance 38 (between the rear wheel assembly 16 and the floor cleaning appliance 38).

A fan device 54 (FIG. 2) is arranged on the chassis 12. The fan device 54 is driven by a motor 56 which, in particular, is an electric motor. The fan device 54 is fluidically connected to the suction beam 48 by a pipe device 58.

When the floor cleaning machine 10 is in cleaning operation, the first suction lip 50 and the second suction lip 52 contact the floor 18. A space 60 is formed between the first suction lip 50 and the second suction lip 52. The space 60 is closed at the sides, for example, by a corresponding formation of the first suction lip 50 and/or the second suction lip 52, in which the suction lips 50, 52 contact each other.

In an alternative embodiment, the space 60 is not completely closed, but partially closed.

The suction beam 48 has one or more vacuuming openings 62. The vacuuming opening 62 or the vacuuming openings 62 has or have a mouth 64 opening into the space 60. The vacuuming opening 62 or the vacuuming openings 62 is or are also connected to the pipe device 58.

The fan device 54 generates a suction flow (indicated by reference numeral 66 in FIG. 2). This suction flow 66 causes the space 60 to be subjected to negative pressure in order to suck in, in particular, excess liquid.

The first suction lip 50 and/or the second suction lip 52 are each provided with cut-outs 72 through which ambient air (indicated by the arrow with reference numeral 74 in FIG. 2) can flow into the space 60. In particular, only the second suction lip 52 is provided with cut-outs 72.

In one embodiment, cut-outs 72, starting from a bottom edge 76, are arranged on the first suction lip 50 and the second suction lip 52.

The suction beam 48 is floatingly arranged on the chassis 12. In particular, it is held by a spring device 78 on the chassis 12. The spring device 78, comprising, in particular, one or more springs, serves, for example, for stabilization when cornering and for provision of a restoring force away from the floor 18.

For example, the suction beam 48 is pressed by its own weight in the direction of the floor 18. The first suction lip 50 and the second suction lip 52 are pressed onto the floor 18 and contact it. During operation, the negative pressure that is created acts additionally and the differential pressure subjects the suction beam 48 to load corresponding to the adjustment of the suction lips 50 and 52 to the floor 18.

In an alternative embodiment, the spring device 78 comprises pressure springs which press the suction beam against the floor to be cleaned.

The floor cleaning machine 10 comprises a control device 80. The control device 80 is coupled with signaling effect to the fan device 54 with the motor 56.

The control device 80 controls (in an open loop or closed loop) the power of the fan device 54 and, consequently, the suction flow 66.

The floor cleaning machine 10 comprises a negative pressure detection device 82. The negative pressure detection device 82 detects at an appropriate place a negative pressure in the course of a suction flow.

In one embodiment, the negative pressure detection device 82 comprises a pressure sensor 84 (or a plurality of pressure sensors 84). This pressure sensor 84 is arranged on the suction beam 48. For example, it is arranged in the vacuuming opening 62.

The negative pressure detection device 82 (and, in particular, the pressure sensor 84) is coupled with signaling effect to the control device 80. It passes its detection signals on to the control device 80.

During suction operation of the floor cleaning machine 10, the spring device 78 first presses with a predetermined force the suction beam 48 in the direction of the floor 18 and, therefore, presses the first suction lip 50 and the second suction lip 52 against the floor 18. The fan device 54 generates the suction flow 66. The negative pressure prevailing at the suction beam 48 determines the relative position of the first suction lip 50 and the second suction lip 52 in relation to the floor 18.

The prevailing negative pressure is, in turn, determined by the power specification of the fan device 54 and by the flow-in relations of ambient air 74 into the space 60. These flow-in relations are, in principle, dependent upon the type of floor 18. They may differ, depending on whether the floor 18 is smooth or rough.

Figure 3C:
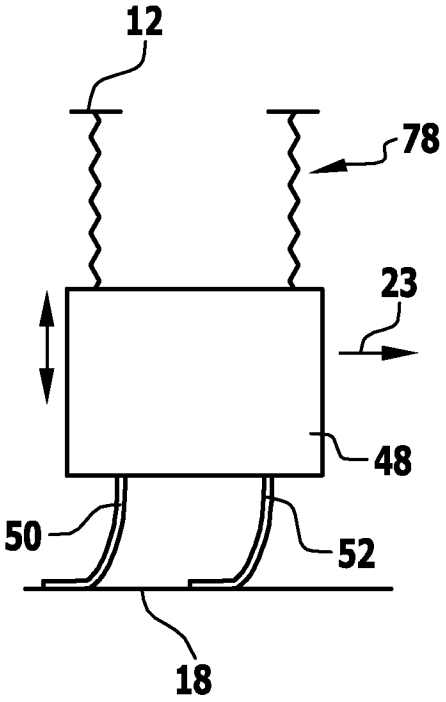
FIG. 3(*a*) shows a first example of a relative position of suction lips (angle of incidence) in relation to a floor to be cleaned in schematic representation.
Figure 3B:
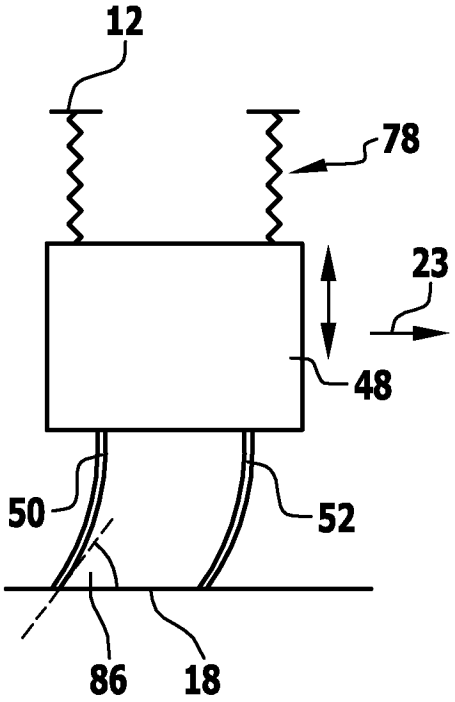
Figure 3A:
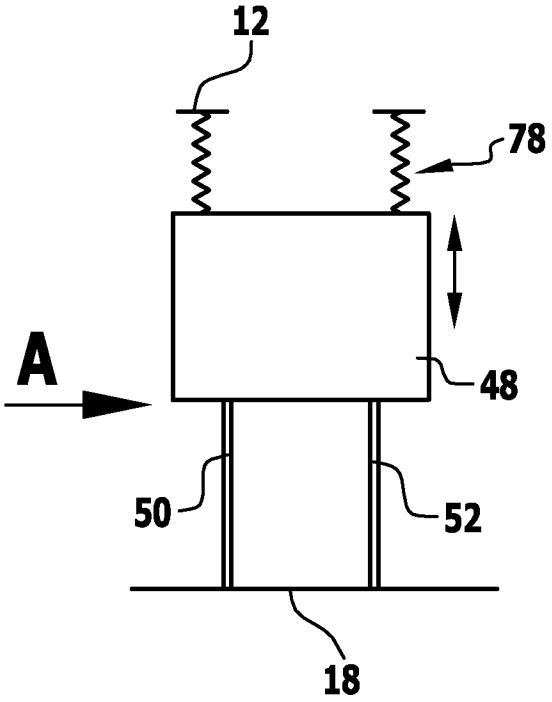
Figure 4:
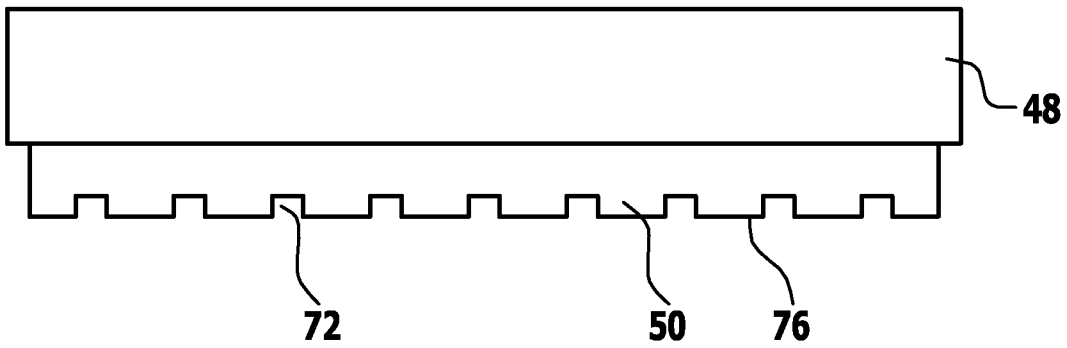
FIG. 4 shows a front view of an embodiment of a suction beam with suction lips in the direction A in accordance with FIG. 3(*a*)

An optimized vacuuming result is achieved when an angle of incidence 86 (FIG. 3(*b*)) for the first suction lip 50 and the second suction lip 52 lies at a certain set value or in a certain set value range. The angle of incidence 86 is that angle which lies between the corresponding suction lip 50 or 52 and the floor 18 at the point at which the suction lip contacts the floor 18.

It has proven advantageous for the angle of incidence 86 to be approximately 45° and, for example, to lie in a range between 35° and 55°.

An angle of incidence 86 of approximately 90° is shown in FIG. 3(*a*). An angle of incidence of approximately 0° is shown in FIG. 3(*c*).

The angle of incidence 86 is specified by the power of the fan device 54. However, with the same power specification, the angle of incidence 86 with the same suction beam 48 may differ with different floors 18. The relative position of the first suction lip 50 and the second suction lip 52, shown in FIG. 3(*b*), with an angle of incidence 86 in the aforementioned set value range is optimal for the vacuuming result.

The negative pressure detected by the negative pressure detection device 82 is a measure for the relative position of the first suction lip 50 and the second suction lip 52 in relation to the floor 18, i. e., for the angle of incidence 86.

In the solution in accordance with the invention, the negative pressure, in particular, in the vacuuming opening 62 is adjusted to a set value by way of corresponding power setting of the fan device 54, in order to obtain an optimized angle of incidence 86 as independently as possible of the structure of the floor 18.

The control device 80 receives by way of the negative pressure detection device 82 corresponding detection results and, in particular, measurement results of the pressure sensor or pressure sensors 84 for the prevailing negative pressure. If there is a deviation from a set value or a set value range for the negative pressure, the power of the fan device 54 is varied accordingly by activating the motor 56, in order to bring the negative pressure to a set value and thereby set the optimized angle of incidence 86.

The adjustment occurs, in particular, automatically so that without any intervention by a driver, as it were, the floor cleaning machine 10 recognizes a variation in the structure of the floor and independently carries out an adjustment in the power setting of the fan device 54, in order to also obtain an optimized vacuuming result in the event of a variation in the structure of the floor.

In particular, a regulation method (control method) is carried out, with a regulation aim of setting a negative pressure set value, in particular, in the vacuuming opening 62 and, therefore, setting a set value for the angle of incidence 86. The variable factor (control parameter) is the power of the fan device 54, the variation being carried out by the control device 80 activating the motor 56 accordingly.

In one embodiment, the regulation is carried out (cf. FIG. 5) by a testing 88 of the negative pressure (detected by way of the negative pressure detection device 82). If the testing 88 shows that the negative pressure detected lies below the set value (indicated by reference numeral 90 in FIG. 5), the power of the fan device 54 is then increased. This is indicated by reference numeral 92 in FIG. 5.

Figure 5:
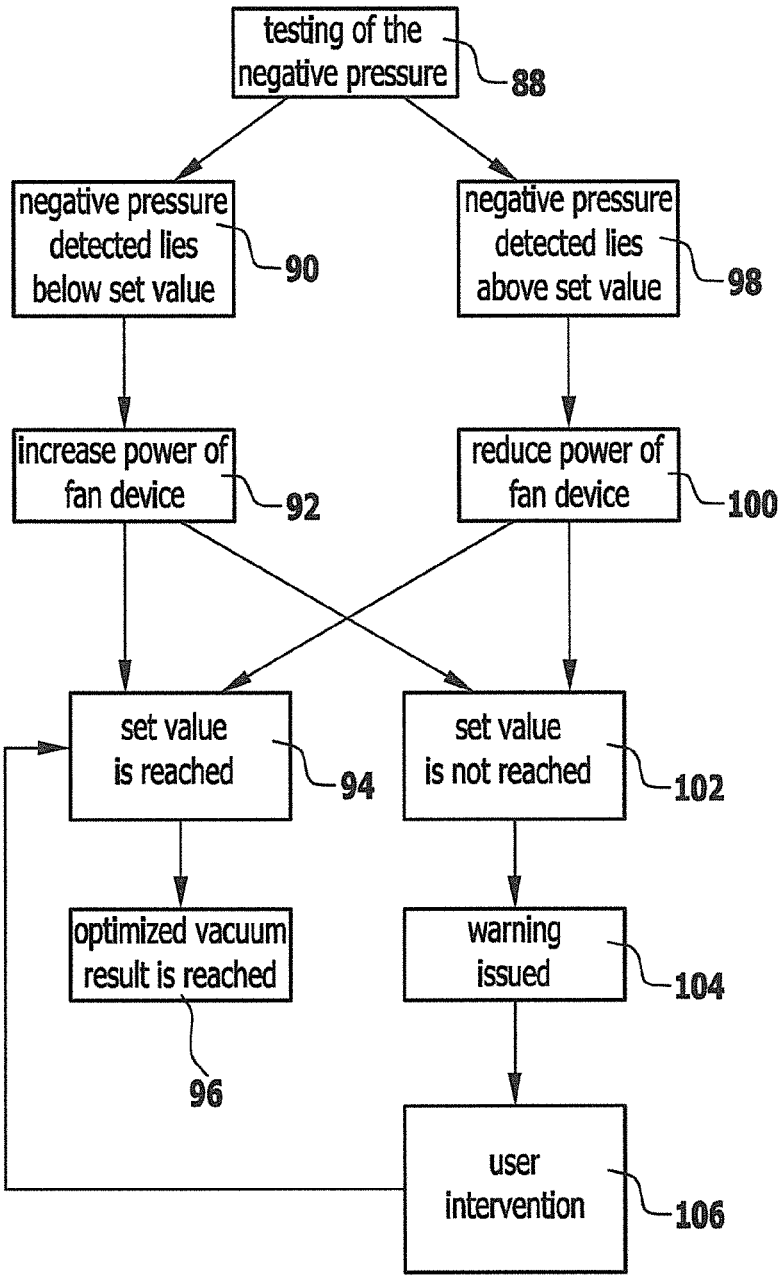
FIG. 5 shows a schematic flow chart for controlling the relative position of suction lips in relation to the floor to be cleaned.

If a further testing shows that the set value is reached (indicated by reference numeral 94 in FIG. 5), an optimized vacuuming result is achieved, which is indicated by reference numeral 96 in FIG. 5. An optimized vacuuming result means that the angle of incidence 86 lies at its set value or in its set value range.

If the testing 88 shows that the negative pressure in the vacuuming opening 62 lies above the set value (indicated by reference numeral 98 in FIG. 5), the power of the fan device 54 is then reduced. This is indicated by reference numeral 100 in FIG. 5.

If a further testing shows that the set value is reached (method step 94), the optimized vacuuming result 96 is then achieved.

Should the set value not be reached after steps 92 or 100, as is indicated by reference numeral 102 in FIG. 5, this means that a problem has arisen which cannot be solved by the corresponding regulation method. Such a problem is, for example, excessive wear of a suction lip 50 or 52, clogging of the vacuuming opening 62 and/or of the pipe device 58, etc. This requires user intervention. A corresponding warning is then issued to the operator. This is indicated by reference numeral 104 in FIG. 5.

After corresponding user intervention (indicated by reference numeral 106 in FIG. 5), the set value should then be reached and step 94 achieved. User intervention is, in particular, checking the floor cleaning machine 10 or cleaning the floor cleaning machine 10 or replacing a suction lip.

During driving operation of the floor cleaning machine 10, in particular, the testing 88 is done permanently and, for example, at specified time intervals. The floor cleaning machine 10 can thus independently and automatically make an adjustment to varying floor structure conditions, in order to also obtain an optimized vacuuming result under different floor structure conditions. In particular, controlling is carried out such that at least approximately the first suction lip 50 and the second suction lip 52 lie at the optimized angle of incidence 86 or in an optimized angle of incidence range (set value or set value range) relative to the floor 18 independently of the floor structure conditions.

Generally, lower power is required for the fan device 54 with smoother floors in comparison with rough floors.

In the solution in accordance with the invention, the power of the fan device 54 is automatically adjusted during drive-suction operation of the floor cleaning machine 10, in order to obtain an optimized vacuuming result.

The power of the fan device 54 is controlled in accordance with the negative pressure data provided by the negative pressure detection device 82. The negative pressure prevailing at the suction beam 48 is a measure for the angle of incidence 86 of the suction lips 50 and 52.

In principle, the set value of the negative pressure or the corresponding set value range depends on the construction of the suction beam 48 in combination with the construction of the spring device 78. For example, the corresponding set value or set value range is stored in the control device in dependence upon the construction of the suction beam 48 and the spring device 78 in a table or as function.

It is, in principle, possible for the negative pressure to also be detected at points other than at the suction beam 48 by the negative pressure detection device 82. Additional warning and evaluating possibilities exist as a result of detection of the negative pressure data by the negative pressure detection device 82. For example, a warning can be issued to an operator if the negative pressure required for cleaning purposes cannot be generated.

Furthermore, a warning or information about wear of the suction lips 50, 52 can be displayed. For example, a corresponding calculation rule is stored for this purpose in the control device 80.

Information or a warning that, for example, a tank lid does not close properly can also be issued.

Further ways of using the negative pressure data obtained are also possible.

The method in accordance with the invention can also be used on other types of floor cleaning machines. For example, it can be used on a robot vacuum cleaner or on floor cleaning machines with articulated steering. It is used, in particular, on self-propelled floor cleaning machines.

| List of Reference Numerals | |
|---|---|
| 10 | floor cleaning machine |
| 12 | chassis |
| 14 | front wheel |
| 16 | rear wheel assembly |
| 18 | floor |
| 20 | steering device |
| 22 | straight-ahead travel |
| 23 | forward travel |
| 24 | steering axis |
| 26 | wheel axis |
| 28 | seat |
| 30 | steering wheel |
| 32 | accelerator pedal |
| 34 | right rear wheel |
| 36 | wheel axis |
| 38 | floor cleaning appliance |
| 40 | scrubbing element |
| 42 | underside |
| 44 | application device |
| 46 | suction device |
| 48 | suction beam |
| 50 | first suction lip |
| 52 | second suction lip |
| 53 | dirty water tank |
| 54 | fan device |
| 56 | motor |
| 58 | pipe device |
| 60 | space |
| 62 | vacuuming opening |
| 64 | mouth |
| 66 | suction flow |
| 72 | cut-out |
| 74 | ambient air |
| 76 | bottom edge |
| 78 | spring device |
| 80 | control device |
| 82 | negative pressure detection device |
| 84 | pressure sensor |
| 86 | angle of incidence |

-continued

| List of Reference Numerals | |
|---|---|
| 88 | testing |
| 90 | "below set value" |
| 92 | "increase power" |
| 94 | "set value reached" |
| 96 | "optimized vacuuming result" |
| 98 | "above set value" |
| 100 | "reduce power" |
| 102 | "set value not reached" |
| 104 | "warning" |
| 106 | "user intervention" |

The invention claimed is:

1. A method for adjusting a position of suction lips of a floor cleaning machine relative to a floor to be cleaned, wherein an angle of incidence of the suction lips to the floor is variable, comprising:

contacting the floor by a first suction lip and at least one second suction lip located at a distance therefrom, which are arranged on a suction beam, said suction beam being floatingly mounted in a chassis of the floor cleaning machine;

generating a suction flow by a fan device, said suction flow subjecting a space between the first suction lip and the second suction lip to a negative pressure;

detecting a negative pressure; and adjusting the suction flow such that the negative pressure lies at a set value or in a set value range, so that the angle of incidence of the first suction lip and the second suction lip on the floor lies at a set value or in a set value range;

wherein the set value or set value range for the angle of incidence of the first suction lip and the second suction lip on the floor lies in the range between 35° and 70°.

2. The method in accordance with claim 1, wherein the negative pressure is measured by one or more pressure sensors.

3. The method in accordance with claim 1, wherein the negative pressure is detected at the suction beam.

4. The method in accordance with claim 1, wherein the suction flow is adjusted by adjusting the power of the fan device.

5. The method in accordance with claim 1, wherein the suction flow is adjusted automatically.

6. The method in accordance with claim 1, wherein the negative pressure adjustment is regulated with the regulation aim that the negative pressure detected lies at a set value or in a set value range.

7. The method in accordance with claim 6, wherein the regulation aim is a certain relative position of the first suction lip and the at least one second suction lip in relation to the floor.

8. The method in accordance with claim 1, wherein the suction beam is pressed against the floor.

9. The method in accordance with claim 1, wherein at least one of the first suction lip and the second suction lip comprises one or more cut-outs through which it is possible for ambient air to flow into the space between the first suction lip and the second suction lip.

10. The method in accordance with claim 1, wherein the set value or set value range for at least one of the negative pressure and the angle of incidence is stored in a table or as function.

* * * * *